US007823996B2

(12) United States Patent
Rimai et al.

(10) Patent No.: US 7,823,996 B2
(45) Date of Patent: Nov. 2, 2010

(54) CONCENTRATING A LIQUID INK JET INK TO TRANSFER TO A RECEIVER MEMBER

(75) Inventors: Benjamin E. Rimai, Webster, NY (US); Donald S. Rimai, Webster, NY (US); Thomas N. Tombs, Rochester, NY (US); James R. Flick, Rochester, NY (US); Robert E. Zeman, Webster, NY (US); James G. Popowich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 423 days.

(21) Appl. No.: 11/445,713

(22) Filed: Jun. 2, 2006

(65) Prior Publication Data

US 2007/0279442 A1 Dec. 6, 2007

(51) Int. Cl.
*B41J 2/195* (2006.01)

(52) U.S. Cl. ..... 347/7

(58) Field of Classification Search ..... 347/101, 347/102, 103

See application file for complete search history.

(56) References Cited

U.S. PATENT DOCUMENTS 3,907,423 A * 9/1975 Hayashi et al. ..... 399/249
5,854,960 A 12/1998 Tagansky et al.
6,245,402 B1 * 6/2001 Schlueter et al. ..... 428/58
6,363,234 B2 3/2002 Landa et al.
2003/0067529 A1 4/2003 May et al.
2004/0090508 A1 * 5/2004 Chowdry et al. ..... 347/103
2007/0279471 A1 12/2007 Tombs et al.
2007/0279472 A1 12/2007 Rimai et al.

FOREIGN PATENT DOCUMENTS

EP 0561419 9/1993
WO 2006/012001 2/2006

* cited by examiner

*Primary Examiner*—Stephen D Meier
*Assistant Examiner*—Alexander C Witkowski
(74) *Attorney, Agent, or Firm*—Lawrence P. Kessler

(57) ABSTRACT

In an apparatus for printing images on a moving primary imaging member by jetting ink, containing a fluid and marking particles, in an image-wise fashion onto the primary imaging member, a device for concentrating the ink prior to transferring a marking particle image to a receiver member. The ink concentrating device includes a fractionating unit for separating fluid of the ink from the marking particles. The fractionating unit is located a predetermined spaced distance from the primary image bearing member. An electrostatic field is established between the primary image bearing member and the fractionating unit for concentrating the marking particles in the liquid of the ink.

20 Claims, 1 Drawing Sheet

CONCENTRATING A LIQUID INK JET INK TO TRANSFER TO A RECEIVER MEMBER

FIELD OF THE INVENTION

The invention relates in general to image printing, and more specifically to a device for concentrating ink jet ink and removing excess fluid prior to imparting the ink onto a receiver member.

BACKGROUND OF THE INVENTION

Ink jet technology has become a technology of choice for printing documents and other digitally produced images on receiver members (e.g., paper and other media). In the ink jet process, described in more detail in *Ink Jet Technology and Product Development Strategies* by Stephen F. Ponds, and published by Torrey Pines Research in 2000, ink is jetted from an ink jet head that includes one or more ink jet nozzles onto a receiver member.

Contrasting with ink jet technology are other printing technologies, such as electrophotography and lithography. Lithography relies on the use of highly viscous inks in which pigment particles are dispersed with relatively small amounts of a fluid such as oil. Typically, the concentration of solids may exceed 90% by weight. The relatively small amount of solvent present in a lithographic print can be readily absorbed by the receiver member or treated using other suitable methods such as drying by heat, cross-linking, or overcoating with varnish.

Another advantage of the high viscosity inks used in lithography, is that the viscosity of the ink limits the ability of the ink to spread. Specifically, ink images often consist of sharp lines of demarcation, such as occur with alphanumeric symbols, halftone dots, edges of printed areas, etc. With high viscosity inks, the tendency of the ink to spread is minimized. This allows images on printed pages to have sharp edges and high resolution. It also reduces the tendency of ink to soak into relatively porous receiver members such as those that do not have a coating such as a clay overcoat. Examples of such receiver members include laser bond papers. If low viscosity ink soaks into the paper, paper fibers can show through. This limits the density of the printed image. Yet another advantage obtained with high viscosity inks is the minimization of halftone dot spread. This allows good gray scales to be produced and, for color images, allows images having a wide color gamut to be printed.

Yet another advantage of high viscosity inks such as those used in lithography is that such inks allow images to be printed on glossy papers such as those having a clay coating or polymer overcoat. Low viscosity inks tend to spread or run on these papers, adversely affecting various image quality parameters such as edge sharpness, resolution, and halftone dot integrity, and color balance.

U.S. Pat. No. 5,854,960 discloses a liquid electrophotographic engine having an inking roller, a squeegee to concentrate the liquid ink, and a photoreceptive member. In such apparatus, liquid electrophotographic ink is applied to an inking roller. The ink is then concentrated using the squeegee, preferably a squeegee in the form of a foam roller. This roller absorbs the clear solvent, leaving the marking particles in a concentrated ink. An electrostatic latent image is then formed on the photoreceptor and the latent image developed into a visible image by bringing the latent image bearing photoreceptor into contact with the concentrated ink bearing inking roller. The marking particles are then electrostatically attracted to the latent image sites on the photoreceptor. It should be noted that, during the ink concentration phase of this process, there is no image information in the ink so that image degradation during the concentration phase cannot occur.

U.S. Pat. No. 6,363,234 discloses a mechanism to concentrate liquid electrophotographic developer including a source of a gas that flows onto a surface containing a liquid developer image and a chamber adjacent to the source and the surface that receives the mixture.

Co-pending U.S. patent application Ser. No. 11/445,712 filed Jun. 2, 2006, discloses a digital printing press capable of producing prints at a high speed and high volume that utilizes ink jet technology, rather than an electrophotographic process, for applying the ink. In this type of apparatus, there is no electrostatic latent image formed on a photoreceptive or primary imaging member. In fact, there is no photoreceptive element and there is no electrostatic charge to attract marking particles to specific sites on the primary imaging member. Rather, small ink droplets, often with volumes as little as a few picoliters, are jetted or otherwise deposited strictly where a portion of the image is to be constructed.

As discussed in co-pending U.S. patent application Ser. No. 11/445,081 filed Jun. 2, 2006, the aforementioned problems associated with the dilute inks used in ink jet printing apparatus can be eliminated by first imaging by jetting the ink onto a primary imaging member, then concentrating the ink, and then transferring the concentrated ink to the receiver sheet such as paper. Alternatively, the concentrated ink can be transferred to a transfer intermediate member and then transferred from the transfer intermediate member to the receiver member.

SUMMARY OF THE INVENTION

In view of the above, this invention is directed to an apparatus for concentrating jetted ink including a fractionating device that fractionates the ink into a concentrated ink layer and a dilute, mainly clear, solvent layer. This invention also discloses an ink composition suitable for use with such a concentration apparatus. The present invention seeks to eliminate excess solvent from an image produced on a primary imaging or other suitable member such as a transfer intermediate member with an ink jet printer by fractionating the ink into a colorant-rich segment and a solvent-rich segment. The solvent-rich segment of the ink is then removed from the aforementioned member and the image then transferred from the aforementioned member to a secondary member, preferably a receiver member such as paper.

Fractionation into two phases is achieved by the application of an electrostatic force. The ink image, which is on an electrically conducting substrate, is passed through a nip formed by the substrate and a fractionating member, with a difference of potential established between the fractionating member and the substrate that drives the electrically charged marking particles to the substrate. The fractionated solvent is then skived from the substrate, leaving behind the image formed by the concentrated developer.

That is to say, according to this invention, in an apparatus for printing images on a moving primary imaging member by jetting ink, containing a fluid and marking particles, in an image-wise fashion onto the primary imaging member, a device for concentrating the ink prior to transferring a marking particle image to a receiver member. The ink concentrating device includes a fractionating unit for separating fluid of the ink from the marking particles. The fractionating unit is located a predetermined spaced distance from the primary image bearing member. An electrostatic field is established between the primary image bearing member and the fractionating unit for concentrating the marking particles in the liquid of the ink.

Another aspect of this invention is the use of a jetable ink having an electrical resistivity in excess of $10^{10}$ Ω-cm and including marking particles.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 2:
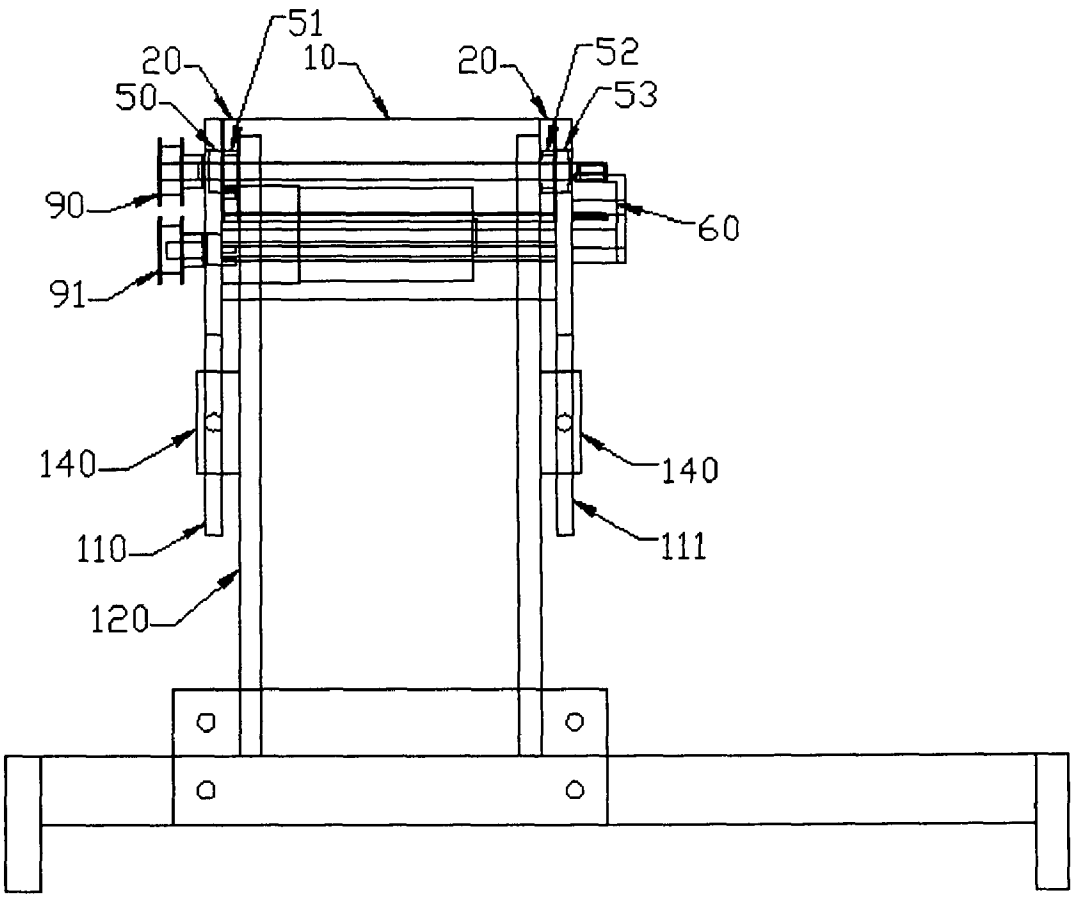
FIG. 2 is a front elevation view of the fractionating apparatus, according to this invention.

A printed image is formed using an ink having electrically charged marking particles. Although ink such as typical ink jet inks including pigment particles can be used (so long as the other physical requirements of the inks as described in this disclosure are met), it is preferable that the ink includes polymeric particles. Although clear polymeric particles can be used if desired, it is generally preferable to use polymeric particles having a dye, pigment, or other colorant. In this disclosure, the term "marking particles" shall include polymeric particles whether or not they include a colorant.

The ink is deposited in an image-wise fashion using appropriate ink jet deposition methods such as a continuous ink jet stream, or drop-on-demand technology onto an electrically conducting substrate. In the preferred mode of operations the substrate is electrically grounded, although it can be electrically biased if so desired. The image is then passed through a nip formed by the image-bearing substrate and a fractionating device. A potential difference is established between the fractionating device and the image bearing substrate. This is preferably done by electrically grounding the substrate and establishing a bias on the fractionating device that would drive the charged marking particles towards the substrate and the supernatant fluid comprising counter ions towards the fractionating device. Although the voltage is not critical, it is preferred that the difference of potential between the fractionating device and the substrate be between 100 and 1,000 volts, preferably between 100 and 500 volts and more preferably between 150 and 350 volts. Lower voltages may not be sufficiently strong to drive the marking particles towards the substrate within the nip residence times. Higher voltages are limited by arcing within the nip and possible by reversing the charge on the marking particles. Such charge reversal would preclude the ability to subsequently transfer the particles. After fractionating, the image is transferred from the primary imaging member to a secondary imaging member. The secondary imaging member could be an intermediate member, a receiver such as paper or transparency stock, etc. Although any appropriate means of transfer to the secondary imaging member could be employed, it is preferred that transfer be accomplished by applying an electrostatic bias of sufficient magnitude and polarity to urge the marking particles to the secondary imaging member. When the secondary imaging member is an intermediate imaging member, transfer to the receiver can, again, be accomplished using suitable transfer technology such as the application of pressure or heat and pressure or any other suitable means. However, it is preferable to transfer the image by applying an electrostatic field of such magnitude and polarity to urge the marking particles away from the secondary imaging member to the receiver. Methods of electrostatic transfer are known in the electrophotographic literature and comprise using a biased roller that presses the receiver against the imaging member, the use of a corona, etc. It should be noted that fractionation can be done, using this same technology, on an intermediate member rather than the primary imaging member. It is not, however, desirable to attempt to fractionate from the final receiver as the receiver may absorb the solvent or a sizable fraction thereof. Moreover, the presence of the relatively dilute, thereby low viscosity, ink can run on the receiver, thereby reducing image quality.

The nip formed between the fractionator and the imaging member should have a spacing of less than 250 μm, preferably less than 50 μm and more preferably less than 25 μm. In some embodiments of this invention, it is possible for the fractionator to be in physical contact with the image-bearing primary imaging member and form a nip with a finite nip width.

As an example, a fractionator can include a wedge-shaped metallic member in which the vertex of the wedge is held in close proximity to the primary imaging member. The fractionator is electrically biased as discussed above in this disclosure and the primary imaging member is grounded. The marking particles are driven towards the primary imaging member, leaving a layer of supernatant solvent that can then be skived off by the wedge.

Figure 1:
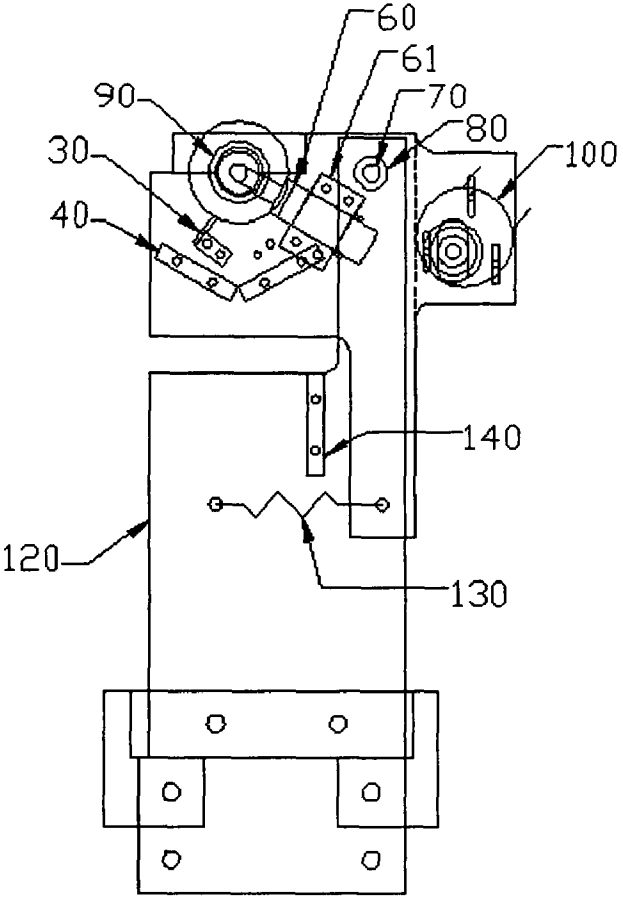
FIG. 1 is a side elevation view of the fractionating apparatus, according to this invention.

Referring to the accompanying drawings, the preferred embodiment of the fractionator is shown in FIGS. 1 and 2. In this embodiment, the fractionation roller 10 is physically and electrically separated from a metallic substrate by a pair of electrically insulating spacing wheels 20. The spacing wheels are made of an insulating polymer such as delrin or nylon and are pressed onto wheel bearings 51 and 52. The support bearings 50 and 53 are concentrically located on an axle shaft (not shown) with wheel bearings 51 and 52 and hold the roller 10 to front bracket 110 and rear bracket 111. Wheel bearings 51 and 52 allow the spacing wheels 20 to rotate on the axle independently of the fractionation roller 10. This allows the fractionation roller to rotate in a direction and at a speed that are different from the speed and direction of the imaging member upon which fractionation is occurring. The fractionation roller is belt driven by drive motor 100 through drive roller pulleys operating through drive roller pulleys 90 and 91. In order to electrically bias the fractionation roller 10, electrical contact is made to the axle shaft by means of a carbon brush 60 that is held in place by the carbon brush bracket 61. The roller apparatus and motor drive mechanism is mounted via front bracket 110, rear bracket 111, and two bottom brackets 120. The distance between the fractionation roller 10 and the imaging member is determined by pushing the fractionation roller towards the imaging member until the spacing wheels 20 contact the imaging member. This is done by allowing the front bracket 110 and rear bracket 111 to pivot on pivoting shaft 70, with a force applied to the two brackets by a spring 130. Travel of the brackets is limited by the travel limiter 140. The space between the front and rear brackets and the bottom bracket is adjusted by spacers 80 in order to accommodate various fractionation roller lengths.

It is further preferred that the fractionator includes a squeegee blade to remove the supernatant liquid from the fractionating roller 10. This blade is preferably made of an elastomeric polymer that is not plasticized by the solvent. The squeegee blade 30 is mounted so as to be in contact with the fractionating roller after fractionation has occurred. The supernatant fluid is then allowed to drain into a drip tray 40, where it can be recycled or discarded.

In another embodiment of this invention, the imaging member on which fractionation occurs comprises a semiconducting polymer such as an elastomer such as polyurethane. Such materials are similar to those often used in transfer rollers in electrophotographic engines. However, in this instance, the polymer cannot be plasticizable or significantly swellable by the ink solvent. Materials such as these typically comprise a charge-conducting agent and typically have resistivities between $10^6$ and $10^{11}$ Ω-cm.

In yet another embodiment of this invention, the fractionator can have a compliant, electrically conducting blade or roller in contact with the imaging surface on which fractionation occurs. Suitable materials include elastomeric materials such as polyurethane or silicone rubber or foams made from such materials. Such fractionating members should also comprise sufficient charge conducting agent so as to result in the fractionating member having a resistivity less than $10^{11}$ Ω-cm and preferably less than $10^6$ Ω-cm.

For fractionation to occur, it is important that the ink possess certain physical properties. These properties are often significantly different from inks commonly used in ink jet printers that do not require electrostatic fractionation. The ink must be sufficiently electrically resistive so as to support an electric-field. The resistivity of the ink is determined by measuring the current generated by an alternating voltage (AC) having a frequency of 1 kHz. The resistance is the ratio of the root-mean-square (RMS) of the applied voltage (approximately 0.707 times the amplitude of the applied AC voltage for a voltage that is varying sinusoidally with time) to the current. The resistance is the product of the resistivity times the separation distance between the electrodes containing the ink divided by the area of the electrode. It is recognized that, for high resistance materials, it is often desirable to surround the biased or active part of the electrode with conductive material that is used to form a grounded or guard ring around the active part of the electrode in order to reduce noise. For the presently described fractionator to work, the AC electrical resistivity of the ink should be greater than $10^9$ Ω-cm and preferably greater than $10^{10}$ Ω-cm. This precludes the use of aqueous based ink jet inks and most alcohol based ink jet inks as their resistivities are typically less than $10^7$ Ω-cm. Rather, the ink should comprise a dispersing liquid such as mineral oils such as Isopar L or Isopar G, both sold by Exxon Corporation, silicone oil, high molecular weight alcohols, etc. While certain alkanes and other aliphatic and aromatic hydrocarbons may be suitable, their associated flammabilities and the potential health risks make them less than fully desirable. For purposes of this disclosure, the AC resistivity was determined using an AC signal with an amplitude of 0.75 VAC, at a frequency of 1 kHz. 0.4 ml of the ink was placed into a cell using a pipette. The electrode spacing between electrodes was 10 μm and the active diameter of the electrodes was 1.3 cm. A guard ring surrounded one of the electrodes.

DC resistivity was determined using the same cell, but applying a DC voltage with a magnitude of 100 V. For fractionation and transfer to occur, the resistivity of the supernatant fluid should be sufficiently high so as not to short the field in either the fractionator or transfer station. This requires that the DC resistivity be in excess of $10^9$ Ω-cm. This high resistivity precludes the use of aqueous and many alcohol based conventional ink jet inks in this process.

The ink should also comprise electrically charged marking particles. While the exact magnitude of the charge is not critical, it should be sufficiently large as to preclude flocculation of the marking particles and enable the particles to fractionate and transfer within the time allowed by the specific engine. Moreover, it is important that the vast majority of the particles have the same charge polarity to enable fractionation and transfer to occur and to prevent flocculation. The charge and charge sign can be determined using known techniques. The marking particles can comprise a colorant, which can be either a dye or a pigment. The marking particles can also comprise a polymeric binder such as polyester, polystyrene, polystyrene butyl acrylate, etc. Alternatively, the marking particles can comprise free pigment particles provided the pigment particles meet the size and charge criteria discussed in this disclosure. However, common ink jet inks that comprise dye would not be suitable as the dye is in solution and, accordingly, could be neither fractionated nor transferred in the manner disclosed herein. The particles need to be sufficiently small so as to be jetable from an ink jet head. This limits their average diameter to less than approximately 3 μm. Conversely, it would be difficult to control the motion of the particles, even in the presence of an electrostatic field, if the average particle diameter was less than approximately 0.1. Smaller particles would be subject to random motion such as that induced by Brownian motion. Particle diameters can be determined by known techniques including laser scattering, transmission electron microscopy, and scanning electron microscopy. In the preferred embodiment, the marking particles would comprise a polymeric binder. The marking particles can be colorless if desired.

The viscosity of the ink is also important, as it must be jetable. It is preferable that the viscosity be less than 20 centipoise, preferably less than 10 centipoise, and even more preferably less than 5 centipoise. The viscosity in the cited examples was measured using a Brookfield viscometer model number DV-E. The spindle model number was 00. The spindle rotated at 100 rpm. In general this viscometer model and spindle model could be used, however, depending on the viscosity the spindle would be rotated between 20 and 100 rpm. Alternatively, the viscosity could be measured with a Brookfield model LV viscometer with a UL adaptor at approximately 12 rpm.

EXAMPLES

Example 1

Commercially available ink sold as cyan colored Signature by Kodak, diluted with Isopar L, was used for this experiment. The marking particles in this ink are approximately 0.1 μm in diameter, as determined using transmission electron microscopy. The AC resistivity measured at 1 kHz with an applied voltage with an amplitude of 0.75 volts, was approximately $1.46\times10^{11}$ Ω-cm. The viscosity was 1.75 cPoise. The ink was jetted onto a primary imaging member comprising nickelized polyethylene terephthalate on an aluminum support. The primary imaging member was approximately 12.5 cm wide by 20 cm long. The nickel layer was electrically grounded. The roller fractionator that was described as the preferred embodiment of this invention was used in this experiment. As the Signature marking particles are charged, the roller was biased at +300 volts to drive the marking particles towards the primary imaging member. The spacer wheels used on the fractionator established a gap of approximately 40 μm. The fractionating roller was rotated at approximately 10.5 to 11 rpm counter to the direction of movement of the primary imaging member.

The ink was jetted onto the entire primary imaging member. It was then driven over the fractionator. After fractionation, the image was transferred to a clay-coated paper (Sappi Lustro Laser) that had been wrapped around a polyurethane transfer roller similar to those used in electrophotographic printing engines. The paper was chosen because it is nonporous and represents a very stressful receiver for conventional ink jet engines. Transfer was accomplished by biasing the roller at −1,000 volts to attract the marking particles to the receiver. It should be noted that it is well known that it is extremely difficult to electrostatically transfer dry toner particles having the same size as the marking particles used in this ink in electrophotographic engines.

During the fractionation process, clear supernatant liquid was observed to flow over the roller. Immediately after transfer, it was found that the image on the receiver was dry and virtually all of the marking particles transferred from the primary imaging member to the receiver. The image was also permanently fixed after transfer without having to use any external means of fixing the image such as fusing. These are surprising results.

In order to quantify how much solvent was present on the receiver after transfer, the image-bearing receiver was placed in a microbalance and its initial mass tared out. Upon evaporation of solvent, the receiver should become lighter. No solvent loss was found, to 0.1 mg, which was the limit of the balance, over a 24 hour period. This confirms that the marking particles were predominantly dry after fractionation.

Example 2

This example is similar to example 1 except that no bias was applied to the fractionator. In addition, no quantitative measurements of solvent evaporation were made. In this case there was a lot of solvent visible on the paper after transfer. Moreover, a large fraction of the marking particles were skived off the primary imaging member by the fractionator. This result shows the importance of the electrical bias applied to the fractionator.

Example 3

This example is similar to example 1 except that the polarity of the bias applied to the fractionator was reversed so as to attract the marking particles to, the fractionator. In this example, there were few marking particles transferred to the receiver, as most were removed from the primary imaging member by the fractionator. Solvent was visible on the receiver after transfer.

Example 4

This example is similar to example 1 except that the design of the fractionator was altered. In this case, the fractionator has an aluminum member, approximately semicircular in shape. This device was attached to the frame of the breadboard that also comprised the track on which the primary imaging member traveled. The trailing edge of this member, referenced to the direction of travel of the primary imaging member, was positioned so that there was a space between the fractionator and primary imaging member of approximately 40 μm at the leading edge of the primary imaging member. However, as the fractionator was fixed to the breadboard and its separation was not indexed to the primary imaging member, the space between the fractionator and primary imaging member varied between 40 μm and 75 μm. In this case, fractionation occurred, as was evidenced by the clear supernatant liquid on the fractionator after the fractionation process. However, the ink on the primary imaging member, although concentrated, was not concentrated to the point at which the transferred image was dry. Rather, some solvent was clearly visible on the transferred image. This example shows that, although the fractionator described in this example is within the specifications of this patent and does function, it is not the preferred mode.

The invention has been described in detail with particular reference to certain preferred embodiments thereof, but it will be understood that variations and modifications can be effected within the spirit and scope of the invention.

PARTS LIST

10 Fractionation Roller
20 Spacing Wheel
30 Squeegee Blade
40 Drip Tray
50 Support Bearings
51 Wheel Bearing
52 Wheel Bearing
53 Support Bearing
60 Carbon Brush
61 Carbon Brush Bracket
70 Pivot Shaft
80 Spacer
90 Roller Drive Pulley
91 Motor Drive Pulley
100 Drive Motor
110 Front Bracket
111 Rear Bracket
120 Bottom Bracket
130 Spring
140 Travel Limiter

What is claimed is:

1. In an apparatus for printing images on a moving primary imaging member, which is rotating in a direction at a process speed, by jetting ink, containing an electrically resistive non-aqueous fluid and marking particles, in an image-wise fashion onto said primary imaging member, so that there is no electrostatic charge to attract marking particles to specific sites on the primary imaging member, a device for concentrating said ink prior to transferring a marking particle image to a receiver member, said ink concentrating device comprising:

a fractionating unit comprising an electrically biased roller rotating counter to said direction at a different process speed, located a spaced distance of less than 250 microns from the primary imaging member for separating said electrically resistive non-aqueous fluid of said ink from said marking particles, said fractionating unit having a predetermined location relative to said primary imaging member; and means for establishing an electrostatic field between said primary image bearing member and said fractionating unit for concentrating said marking particles in said liquid of said ink using said electrically biased roller;

wherein there is no photoreceptive element on the primary imaging member.

2. The apparatus according to claim 1, wherein said predetermined location of said fractionating unit is a spaced distance from said primary imaging member of less than 50 microns.

3. The apparatus according to claim 1, wherein said fractionator further comprises a pair of electrically insulating spacing wheels rotatable in a direction counter to said process direction of movement of said primary imaging member such that said wheels can rotate on an axis independent from the electrically biased roller at a speed.

4. The apparatus according to claim 3, wherein the wheels rotate without disturbing an image on said primary imaging member.

5. The apparatus according to claim 3, wherein the axis of the electrically insulating spacing wheels is the same as the axis of the electrically biased roller.

6. The apparatus according to claim 1, wherein a skive member is located relative to said primary imaging member for skiving the effluent liquid off said primary imaging member to concentrate said ink.

7. The apparatus according to claim 1 wherein said marking particles of said ink include colorant particles.

8. The apparatus according to claim 7 wherein said colorant particles have a mean average diameter between 0.1 and 3.0 μm.

9. The apparatus according to claim 8 wherein said ink has an AC resistivity greater than $10^9$ Ω-cm.

10. The apparatus according to claim 8 wherein said ink has an AC resistivity greater than $10^{10}$ Ω-cm.

11. The apparatus according to claim 8 wherein said an ink has a DC resistivity greater than $10^9$ Ω-cm.

12. The apparatus according to claim 1, wherein the speed of the electrically biased roller is approximately 10.5 to 11 rpm.

13. The apparatus according to claim 1, wherein the electrically resistive non-aqueous fluid is a solvent.

14. A method for printing images on a moving primary imaging member by jetting ink, containing an electrically resistive non-aqueous fluid and marking particles, in an image-wise fashion onto said primary imaging member which is rotating in a direction at a speed, so that there is no electrostatic charge to attract marking particles to specific sites on the primary imaging member, including the steps of:

spacing an electrically biased roller rotating counter to said direction at a speed different from said primary imaging member, for separating said electrically resistive non-aqueous fluid, a spaced distance of less then 250 microns from said rotating primary imaging member;

concentrating said ink prior to transferring said marking particles comprising an image to a receiver member by fractionating the ink for separating fluid of the ink from the marking particles by establishing an electrostatic field with the primary image bearing member to subject the ink to said electrostatic field; and transferring said image to a receiver member;

wherein there is no photoreceptive element on the primary imaging member.

15. The method according to claim 14, wherein in the concentrating step, the effluent liquid is skived off said primary imaging member.

16. The method according to claim 14, further including providing a pair of electrically insulating spacing wheels rotatable in a direction counter to said process direction of movement of said primary imaging member such that said wheels can rotate on an axis independent from the electrically biased roller.

17. The method according to claim 16, wherein the axis of the electrically insulating spacing wheels is the same as the axis of the electrically biased roller.

18. The method according to claim 16, wherein the wheels can rotate without disturbing an image on said primary imaging member.

19. The method according to claim 14 wherein said marking particles of said ink include colorant particles.

20. The method according to claim 14, wherein the speed of the electrically biased roller is between approximately 10.5 and 11 rpm.

* * * * *